United States Patent [19]

Sullivan

[11] 4,202,065

[45] May 13, 1980

[54] COLLAPSIBLE BABY ENCLOSURE

[76] Inventor: Barry J. Sullivan, #29, 670 San Antonio Rd., Palo Alto, Calif. 94301

[21] Appl. No.: 869,252

[22] Filed: Jan. 13, 1978

Related U.S. Application Data

[63] Continuation-in-part of Ser. No. 799,790, May 23, 1977, abandoned.

[51] Int. Cl.[2] ..... A47D 7/00

[52] U.S. Cl. ..... 5/99 A; 5/99 C

[58] Field of Search ..... 5/99 A, 99 B, 99 C, 5/99 R, 93 R, 93 B, 110, 114, 13, 14; 135/4 R, 7.1 R

[56] References Cited

U.S. PATENT DOCUMENTS

| | | | |
|---|---|---|---|
| 2,561,637 | 7/1951 | Rex | 5/99 C |
| 2,624,054 | 1/1953 | Plant | 5/99 A |
| 3,165,760 | 1/1965 | Abajian | 5/99 R |
| 3,606,620 | 9/1971 | Glover | 5/99 R |
| 3,810,482 | 5/1974 | Beavers | 135/4 R |

*Primary Examiner*—Alexander Grosz
*Attorney, Agent, or Firm*—C. Michael Zimmerman

[57] ABSTRACT

An infant's crib construction is described which is collapsible to a compact bundle. The crib includes a baby enclosure of a pliant material and a frame of elongate substantially parallel side rods held in a spaced apart, erected position by beyond-center locking toggle spiders at the frame ends.

15 Claims, 20 Drawing Figures

12'
13'
54
56
53
51
54
54
56
53
56
53
62
53
53'
82
53
82'
53'
53

52
68
16'
59
58
16'
63
17'
61
59
68
58
61
57
17'

COLLAPSIBLE BABY ENCLOSURE

CROSS REFERENCE TO RELATED U.S. APPLICATION

This application is a continuation-in-part of copending Patent Application Ser. No. 799,790 filed May 23, 1977 entitled PORTABLE INFANT'S CRIB, now abandoned.

DISCLOSURE

BACKGROUND OF THE INVENTION

This invention pertains to a collapsible baby enclosure and more particularly to such an enclosure which can be erected and collapsed simply by applying endwise forces acting on the end frame structure thereof.

Portable cribs and playpens have, in many instances, been characterized by incorporating release mechanisms, clips, buttons, and the like which may be a danger to an infant in the same. Moreover, such cribs and playpens typically have not been completely collapsible, often only being collapsible in one direction. The baby enclosures described in U.S. Pat. Nos. 2,561,637 and 2,586,247 are examples. Accordingly, there has been a need for an improved portable construction.

SUMMARY OF THE INVENTION

The present invention provides a collapsible baby enclosure which does not rely on release mechanisms or the like accessible to the baby for its operation. Moreover, it is collapsible in a simple manner to a compact bundle which is quite easily stored or ported from one location to another. In its basic aspects, the baby enclosure of the invention includes a baby containing structure of a pliant material which when the enclosure is in an erected condition defines a desired baby containing shape having a pair of opposed side walls, and a collapsible frame to support such structure. The frame includes elongate side members or, in other words, rods, extending generally rigidly for the full length of each of the side panels of the containing structure, adjacent the upper and lower margins thereof. As a particular salient feature of the invention, the enclosure also includes a pair of collapsible end support structures coupled to the side members at opposite ends of the frame, each of such end support structures being manipulatable between a frame collapsed position in which the ends of the side members coupled thereto are positioned close to one another, and a locked, frame erected position in which such end support structure maintains the side members spread apart from one another at such end. When the frame structure is in such erected position it supports the enclosure for containing the baby in such desired shape.

Most simply and desirably, the end support structures are beyond-center locking toggles having struts hinged to the ends of the side members and connecting the same hingeably to a central hub, which hub and struts are nestled between the side members when the toggle is in the frame collapsed position but are spaced outwardly therefrom when the toggle is in the locked, frame erected position. Beyond-center locking toggles provide structures which are manipulatable in a simple manner to convert the enclosure from one of its conditions to the other. Moreover, the spacing of the toggles outwardly from the remainder of the frame aids in separating the same from any baby supported within the containment structure.

In general, it is an object of the present invention to provide an improved collapsible baby enclosure construction.

Another object of the present invention is to provide such a construction which is readily erectable from an elongate bundle of side and end frame members disposed in substantially parallel relation.

The foregoing and other objects and features of the invention will become more readily evident from the following detailed description of a preferred embodiment when considered in conjunction with the drawings.

Figure 1:
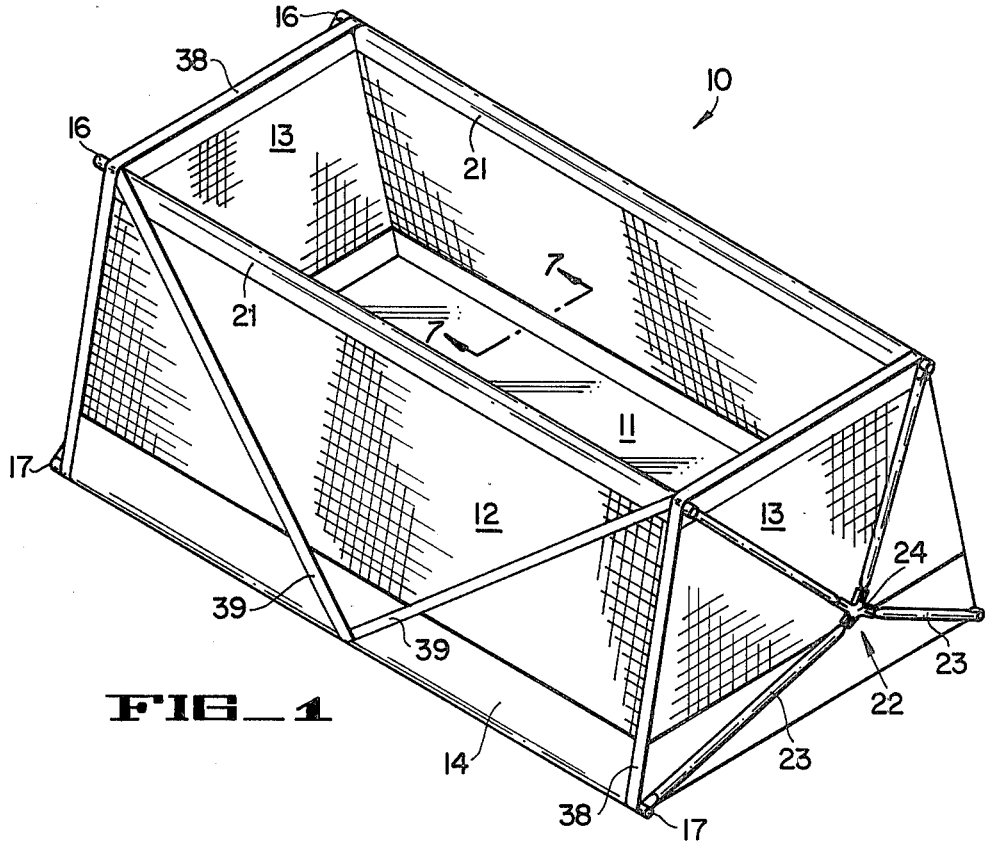
FIG. 1 shows a diagrammatic isometric view of a crib construction according to the invention in its erected position.
Figure 5:
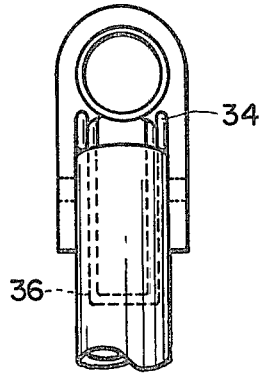

FIGS. *2a–2c* show diagrammatic side elevation views of the construction shown in FIG. 1 at progressive stages of being collapsed;

FIGS. *3a–3c* show diagrammatic end views of the construction shown in FIG. 1 in progressive stages of being collapsed;

FIGS. *4a* and *4b* diagrammatically show an enlarged side elevation view of opposite ends of an end strut coupled in FIG. *4a* to an upper frame member of the crib construction of FIG. 1 and coupled in FIG. *4b* to a central hub thereof;

FIG. 5 shows an enlarged end elevation view of the showing of FIG. *4a;*

Figure 8:
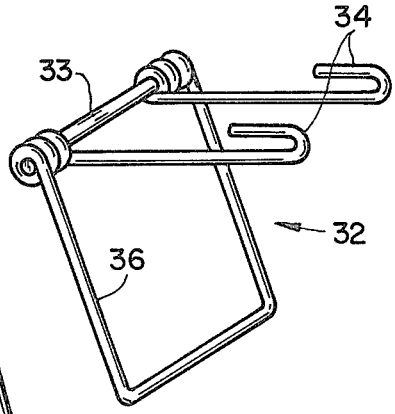
Figure 7:
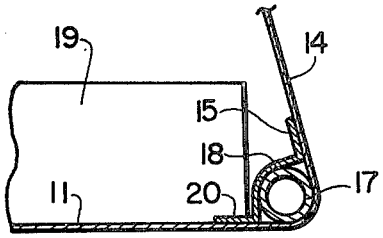
Figure 6:
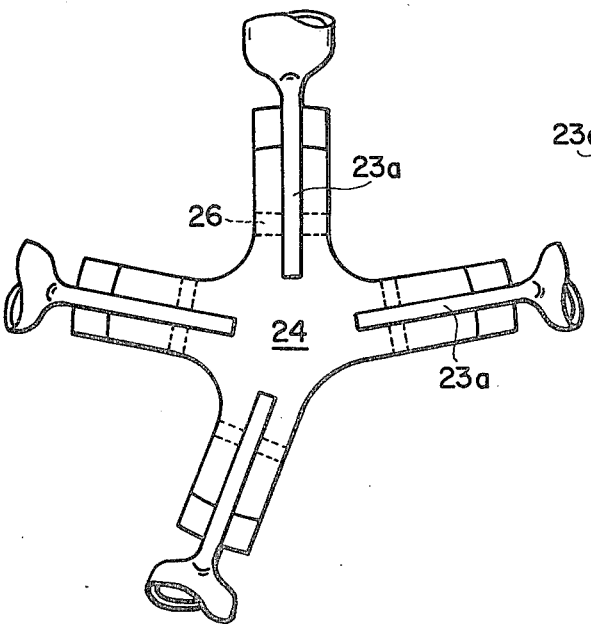
Figures 9, 10:
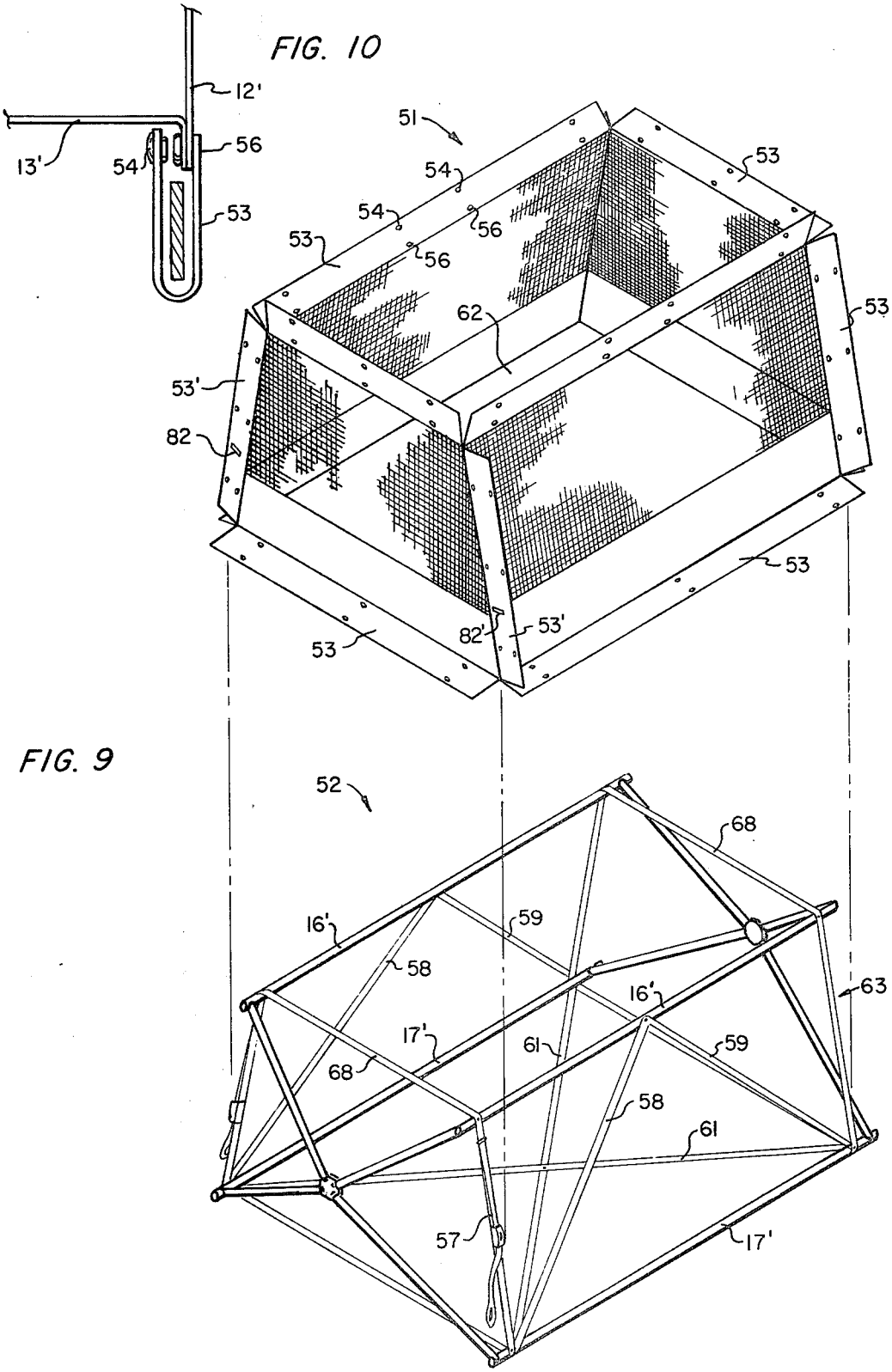
Figure 11:
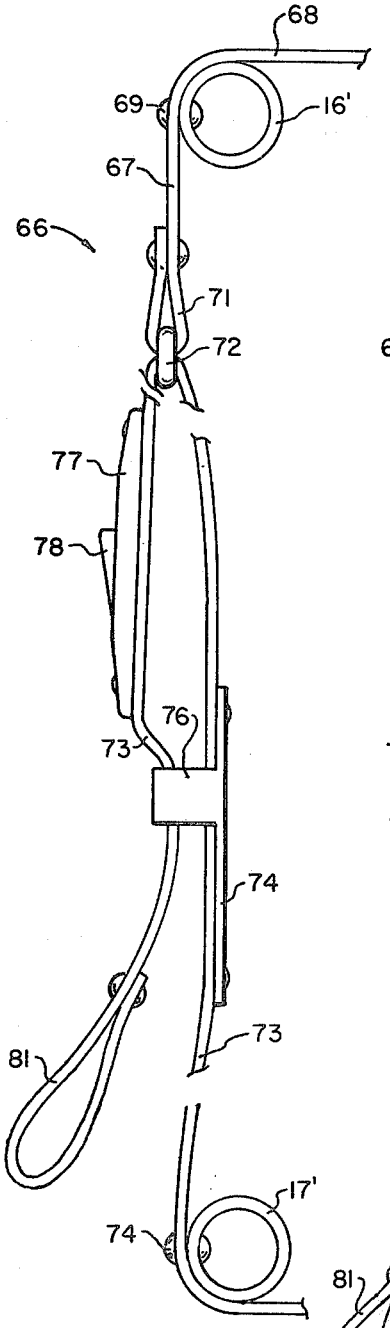
Figure 12:
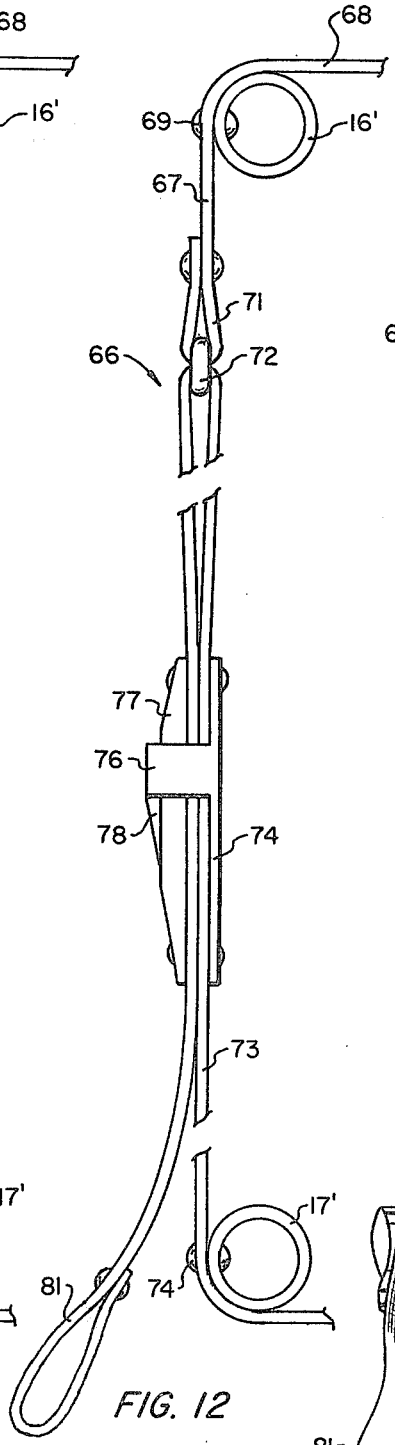
Figure 13:
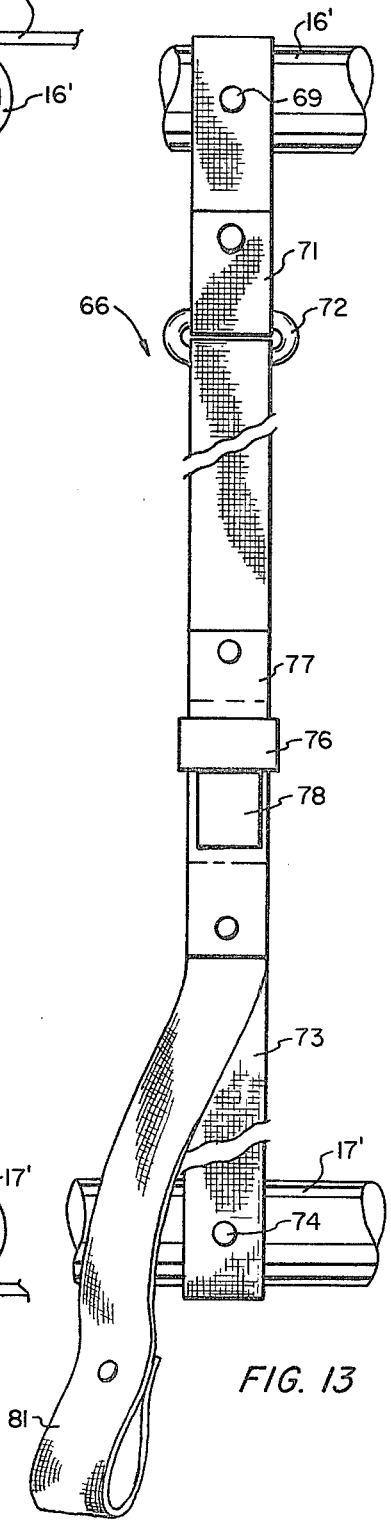
Figure 14:
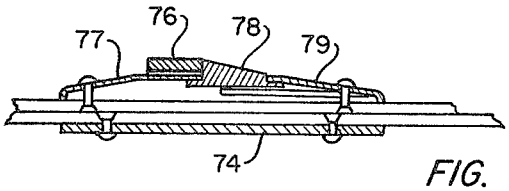

FIG. 6 shows an enlarged end view of a central hub assembly of the crib construction of FIG. 1 for coupling four end strut members thereto;

FIG. 7 shows an enlarged detail view in section along the line 7—7 of FIG. 1 showing the attachment of a bottom frame member to the pliant side and bottom wall panels of the baby containment structure;

FIG. 8 is a diagrammatic perspective view of a spring element used in the preferred embodiment of FIG. 1;

FIG. 9 is a diagrammatic isometric view of an alternate preferred crib construction embodiment of the invention, showing the same with the baby containment structure separated from the frame structure;

FIG. 10 is an enlarged partial view showing the manner in which the containment structure of the embodiment of FIG. 9 is secured to the frame structure;

FIGS. 11 and 12 are enlarged diagrammatic and broken side elevation views of a portion of the tension loop of one of the end support structures of the frame of the embodiment of FIG. 9, the figures showing the same in differing conditions;

FIG. 13 is an enlarged, front elevation view of the portion of the tension loop illustrated in FIG. 12; and FIG. 14 is a further enlarged side sectional view of the expansion snap-lock of the portion of the tension loop shown in FIGS. 11–13.

DETAILED DESCRIPTION OF PREFERRED EMBODIMENTS

With reference first to FIGS. 1 through 8, a crib construction is illustrated incorporating a preferred embodiment of the invention. The crib 10 includes a baby containment structure of a pliant material, and a collapsible frame structure to support such containment structure. The containment structure comprises a bottom panel 11 and opposed side and opposed end panels, 12 and 13, all of pliant material. In the present instance, the side and end panels are made of a netting material with a broad lower edge margin 14 comprising a substantially less pervious material so as to protect an infant from drafts when the crib is disposed on the floor of a room, or otherwise.

The frame structure cooperates with the containment structure to form a structurally rigid, open box-like enclosure to contain the baby. The frame structure includes four elongate side members (rods) 16, 17 secured respectively along the top and bottom edges of the side panels 12 and along the side two edges of the bottom panel 11 (as shown in FIG. 7). Accordingly, a bottom side member 17 of rigid or semi-rigid material lies captured in an elongate pocket formed by providing an elongate web 18 of material stitched at its upper edge margin 15 to the lower edge margin 14 of the side panel and stitched at its other edge margin 20 to the bottom panel 11 for retaining member 17 therein. For comfort of the infant a foam pad 19 has been disposed on bottom panel 11. Side members 16 carry the upper edge of side panels 12 in similar style by overlapping the edge margin 21 around member 16 to be stitched therealong.

Figure 2A:
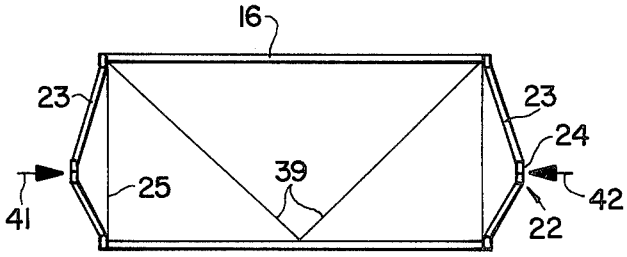
Figure 3A:
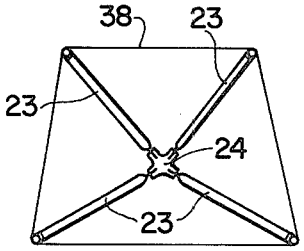
Figure 2B:
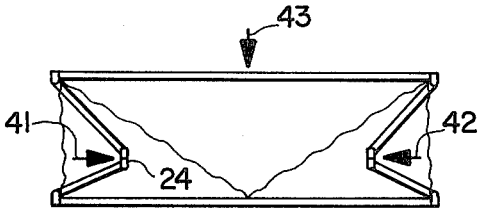
Figure 3B:
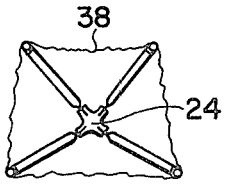
Figure 2C:
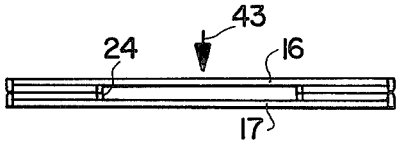
Figure 3C:
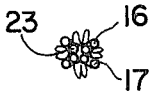
Figure 4A:
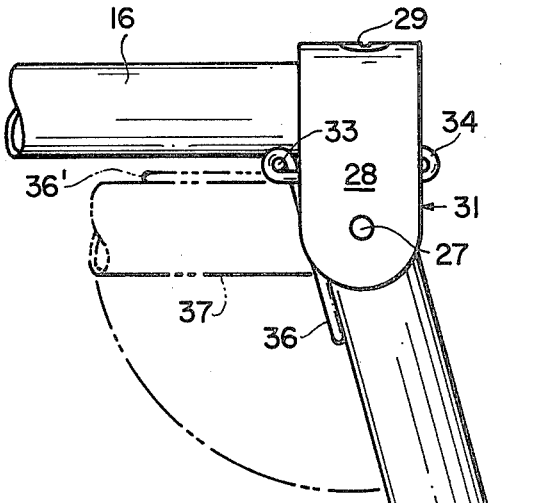

End supporting structures at the frame at each end of the crib structure move from a first position nestled within the length of the crib when it is collapsed as shown in FIGS. 2*c* and 3*c* to a second position disposed beyond the end of the baby containment structure when the crib is in its erected position as shown in FIG. 2*a*. Each of such end support structures includes a beyond-center locking toggle spider assembly 22 coupled to and serving to spread the ends of members 16, 17 apart as the center of the spider moves from a collapsed position to an erected position. It is to be observed that the maximum spreading of elongate struts 23 is defined at a position intermediate the first and second positions, i.e., at the toggle center plane. That is, as the central hub 24 passes a plane 25 generally at the ends of side members 16, 17, the ends will be spread a maximum distance apart.

Figure 4B:
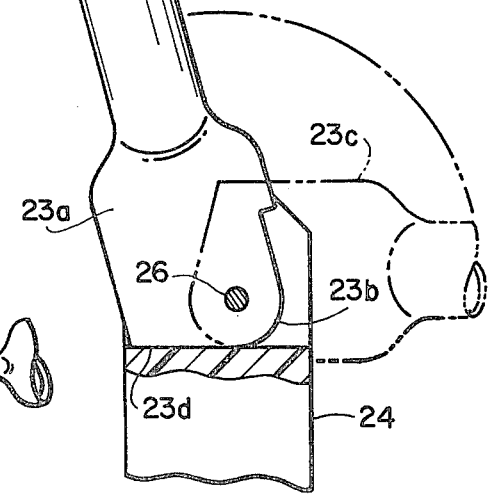

The inner ends of struts 23 are all hinged to hub 24 as shown in FIG. 4*b* by means of hinge pins 26. The end 23*a* of each strut 23 coupled to hub 24 is formed with a rounded surface 23*b* which serves to permit strut 23 to be rotated about hinge pin 26 to the position shown in phantom lines 23*c*. This movement permits hub 24 to travel longitudinally inwardly of the crib assembly. On the other hand, when hub 24 is urged longitudinally outwardly of the crib assembly the flat bottom surface 23*d* of strut 23 ultimately strikes a correspondingly flat surface of hub 24 so as to preclude further longitudinally outward movement thereof.

Hinge pins 27 couple the upper ends of upper struts 23 of each spider to the associated ends of side members 16 and the lower ends of the lower struts to the associated ends of side members 17. Pins 27 extend between the sides 28 of a hinge 31 secured by means of a screw 29 or other fastening means to the respective side members.

Means tending to yieldingly move hub 24 from its longitudinally inwardly position to a longitudinally outwardly position includes spring elements 32 shown best in FIG. 8 coiled about a pivot pin 33 in a manner providing a pair of laterally extending hook portions 34 adapted to engage a portion (not shown) of hinge 31. Each spring element 32 further includes a loop portion 36 forming a leaf disposed to bear against the back side of the top of strut 23. When strut 23 is in an inwardly folded position relative to side member 16 as shown in phantom line 37 it is evident that the downwardly depending loop or leaf 36 (as shown in phantom lines 36') has been moved to a position substantially parallel to side member 16.

As thus arranged, the force of spring 32 is applied to the back of strut 23 to urge hub 24 longitudinally outwardly of crib 10.

As noted above, as hub 24 moves through the plane 25 including ends of side members 16, 17 maximum separation between the side members is achieved. A flexible strap circumscribes the ends of side members 16, 17 for retaining crib 10 in an erected position with hub assembly 24 disposed longitudinally outwardly of the containment structure. In this embodiment, such strap is a somewhat elastic tension band 38 trained about the ends of side members 16, 17 for drawing the ends together. Accordingly, after hub assembly 24 has moved to its longitudinally outwardly position tension bands 38 will yieldingly maintain the struts 23 and hub 24 in a containment structure supporting position. Side straps 39 extend diagonally from a midpoint along the bottom of each side panel to the upper ends of the side panel in order to provide reinforcement to the pliant side panels of the crib assembly.

In order to collapse or fold the crib construction it is merely necessary to press longitudinally inwardly in the direction of arrows 41, 42 so as to carry each hub 24 "over center" relative to the plane 25 of tension bands 38. Thereafter, a downward collapsing force can be applied by hand in the direction of arrow 43 acting on upper side members 16.

It is to be observed that the double ended hinged support of each of struts 23 permits them to lie substantially parallel to side members 16, 17, and all of the struts and side members can be drawn together into a tight bundle of substantially parallel strut and side support members with the pliant panels folded therewith. The mattress can then be wrapped around the collapsed frame and panels.

Another preferred embodiment of the invention is illustrated in FIGS. 9 through 14. The containment structure of this embodiment, generally referred to by the reference numeral 51, is completely separable from the frame structure 52. That is, the panels of the containment structure are secured to the elongate side members and tension straps of the frame in a detachable fashion. To this end, the containment structure is provided with securance flaps 53 along each of its edges and at the junctions of its various panels. Each of such flaps includes snap fasteners spaced along its length with the male 54 and female 56 portions of each spaced apart from one another so that when such snap fasteners are secured together, their associated flap defines an elongate pocket to receive a structural member of the frame. In this connection, reference is made to FIG. 10 which illustrates one of the flaps at a junction of a side panel 12' with an end panel 13' looped about the flexible strap 57 of one of the end toggle arrangements. When the crib construction is in its operable position, the remaining flaps 53 are similarly looped about adjacent structural members of the frame structure. However, the containment structure is simply detachable from the frame to facilitate laundering, etc.

While the pliant panels of a containment structure can be used as tension members to add structural rigidity to an erected enclosure, in an embodiment such as the one shown in FIGS. 9–14 in which the containment structure is completely separable from the frame structure, it is preferred that the frame structure itself include all of the structural components needed to maintain the erected enclosure rigid. Such additional structural strength is added to the frame structure of the embodiment of FIGS. 9–14 without detracting from its collapsability. To this end, inelastic tension straps 58 and 59 of a flexible material are secured diagonally between the upper and lower elongate side members 16′ and 17′ of each side of the frame. Because each of such straps is flexible, it will not interfere with movement of the elongate side members toward one another when the frame structure is collapsed. However, when the frame structure is erected and the straps are extended they will add triangular support components to the sides of the frame structure.

As shown, the strap 58 at each frame side extends in one diagonal direction from one end of the side member 17′ to generally the midpoint of the upper side member 16′, whereas; the other strap 59. Extends diagonally in the other direction from such midpoint to the other end of the lower side member 17′. The provision of such straps in opposite diagonal directions will assure that the same provide vertical stability to the frame sides in both directions longitudinally of the crib.

Tension straps are also used to provide horizontal stability to the bottom of the frame structure. That is, a pair of straps 61 are secured diagonally between opposite ends of the elongate side member 17′. Such straps are also of an inelastic, flexible material and do not interfere with collapsing of the structure while yet providing tension support. It should be noted that in some instances the function of such straps can be adequately served by the bottom panel 62 of the containment structure, especially when such bottom panel is rigidly secured between the side members.

In the earlier described embodiment, the flexible straps circumscribing the ends of the elongate side members for retaining each of the toggle assemblies in its locked position were somewhat elastic to permit the center hub of each toggle to pass through the toggle center plane. In this embodiment, such flexible straps, straps 57 and 63, are inelastic but are otherwise expandable to facilitate the passage of the toggle end structures. First of all, it should be noted that it is not necessary that both of the flexible straps 57 and 63 be expandable. It has been found that a frame structure can be designed to accommodate the passage of one of such toggle structures through its center plane without the flexible strap of such toggle arrangement being expandable. That is, by securing to the side members inwardly of the hinge coupling of the toggle struts to such side members, there will be sufficient slack in the strap when the opposite toggle assembly is still in its generally collapsed position to permit passage of the hub of the toggle of which the strap is a part through the toggle center plane for locking. When the other toggle arrangement is manipulated to its frame erected position, the side members will be spread further apart at the location of the strap of the other toggle member to take up such slack.

It is the flexible strap 57 of the frame structure 52 which is expandable. To this end, tension strap 57 includes snap-lock assemblies along the portions thereof at opposed sides of the frame extending between the upper and lower elongate side members. Each of such portions, designated generally by the reference numerals 66 in FIGS. 11 through 13, includes an upper strap piece 67 which is, in effect, a continuation of the upper horizontal piece 68 (FIG. 9) of the tension strap. As illustrated, strap piece 67 is secured, such as by means of a rivet 69, to the upper elongate side member 16′ and terminates in a loop portion 71 supporting a slide ring 72 of a metal or the like.

Each side portion 66 of tension strap 57 also includes a lower piece 73 secured via rivet 74 or the like to the lower elongate side member 17′. Each lower piece 73 extends upward from its associated side member 17′ and is looped through the ring 72 supported by the corresponding strap piece 67. It is the piece 73 of each strap portion 57 which includes a snap-lock assembly enabling the tension on such strap portion to be released. More particularly, there is secured to that segment of the piece 73 which extends upwardly from the side member 17′, a snap-lock keeper in the form of a plate 74 which is riveted to such segment and supports a transversely projecting rectangular collar 76. That segment of strap piece 73 which extends downward from the ring 72 passes through collar 76, and has a snap-lock catch secured to the same. As illustrated, the snap-lock catch includes a generally hollow body portion 77 riveted to the strap 73, supporting a catch 78. The catch 78 is normally resiliently urged into the position shown in the figures by, for example, a leaf spring 79 within the body 77.

The snap-lock catch is designed, in a generally conventional manner, to permit passage of the catch 78 through the collar 76 in one direction of travel of the segment of the strap piece to which it is secured, but prevent reverse travel of the same through the collar without actuation. That is, the configuration of the catch provides a ramp which engages the collar 76 so that the catch is depressed when it moves downward through the collar. However, once catch 78 passes through the collar 76, it is again resiliently urged outward by spring 79 to present a blunt face to the collar, blocking upward movement of the catch lock portion and the segment of the strap piece 73 to which it is secured. The free end of the strap piece 73 is provided with a loop 81 to facilitate the application of downward pressure to the strap to pull the catch portion through the collar. Once the catch portion passes through such collar, it can only be moved upward when the catch 78 is depressed to clear collar 76.

It will be appreciated from the above that the tension strap 57 is expandable at two separate locations adjacent opposed sides of the frame in a very simple manner to permit the passage of the hub and struts of the toggle of which it is a part through the toggle center plane. Such expansion is simply achieved by depressing the catches 78. The ends of the elongate side members 16′ and 17′ which are tied together by the strap are then movable apart somewhat to pull the catch portion 77 of the snap-lock through the collar 76 and release the tension on the strap. Once the beyond-center toggle is moved through the toggle center plane, the side portions of the tension straps again can be simply connected merely by downward pressure on the loops 81.

When the baby containment structure of this embodiment is secured to the frame structure, the flaps 53′ will encompass the snap-lock arrangement just described and thus shield the same from a baby within or without the containment structure. In this connection, slits 82 are provided in the flaps 53′ to permit passage of the loops 81 to the exterior for access to be pulled. The catches 78 can be depressed in a simple manner even though they are covered by the flap.

In all other respects, the embodiment of the invention of FIGS. 9–14 is the same as the embodiment of FIGS. 1–8.

From the foregoing description of two preferred embodiments it will be readily evident that there has been provided an improved baby enclosure which can be readily erected for use or collapsed to form a small bundle of parallel elements for limited space storage. Further, it is noted that the side walls of the containment structure slope upwardly and inwardly to extend over at least a portion of an infant located within the crib in order to make it difficult if not impossible for the infant to crawl out of the crib.

It is further evident that the frame end support structures remain sufficiently beyond the end panels when the crib is erected to minimize the likelihood of contact therewith by an infant in the crib.

As thus described, there has been provided a unique structural system allowing a crib or playpen to fold into a compact linear bundle of parallel struts which can be easily carried. The assembly requires no release mechanisms, clips, or buttons and is controlled by the properly combined use of tension and compression members operating in conjunction with the pivoting hubs and joints.

The foregoing structure has a number of advantages including its ease of folding, the lightness of the entire assembly, and the tight compact bundle into which it collapses. The dimensions of the collapsed assembly can correspond to a simple tube of the order of 42 inches in length (in the case of a crib) with a diameter of 8 to 10 inches depending on the thickness of the mattress which is employed.

In addition, the crib offers numerous safety features that are related to its form and structure including a top railing which is completely padded with no protruding screws, fasteners or clips on which a baby may be injured. The compression struts on the ends of the crib are bowed outwardly from the crib so that if the baby should fall there is little likelihood of it striking its head on any solid supporting member. Further, the lower edge margins of the side and end panels of the crib extend upwardly to a height of the order of six inches to provide a windbreak that will protect a sleeping baby from floor drafts. The base panel is porous enough to avoid any danger of the baby smothering or suffocating.

Further, the above construction lends itself readily to disposing the crib directly upon the ground to provide greater stability and minimizing the danger of injury if a child should climb over the side of the crib and fall. The sides of the crib are sloped inwardly as noted above to minimize the possibility of the child tipping the crib over by pushing or leaning on the side rails. Finally, there are no protruding parts that a baby in the crib can contact and possibly cause injury.

Although the invention has been described in connection with preferred embodiments thereof, it will be appreciated by those skilled in the art that various changes and modifications can be made without departing from the spirit of the invention. For example, while it has been described in connection with crib assemblies, it is equally applicable to other types of baby enclosures, such as playpens. Moreover, some or all of the diagonal tension straps may be eliminated from the frame structure, depending upon the required structural rigidity. Because of these and other modifications and changes which can be made, it is intended that the coverage afforded applicant be limited only by the language of the claims and its equivalent.

I claim:

1. A structurally rigid baby enclosure erectable from a collapsed condition comprising:
   - A. a baby containment structure of a pliant material including:
     - (1) a pair of opposed side panels;
     - (2) a pair of opposed end panels; and
     - (3) a bottom panel; and
   - B. a collapsible frame structure to support said enclosure including:
     - (1) four side rods extending generally parallel to one another for generally the full length of said structure respectively adjacent the upper and lower margins of said side panels; and
     - (2) a pair of collapsible end support structures coupled respectively at opposite ends of said frame structure to all four of said side rods, each of said end support structures being manipulatable between a frame collapsed position in which the ends of all four of said side rods coupled thereto are positioned close to one another; and a locked, frame erected position in which said end support structure maintains said side rods spread apart from one another at said end.

2. A structurally rigid baby enclosure according to claim 1 wherein said baby containment structure of a pliant material is supported by said frame positioned at a location inwardly of said frame and said end support structures are spaced outwardly from said baby containing structure when in said frame erected position to minimize likelihood of contact therewith by a baby in said containment structure.

3. A structurally rigid baby enclosure according to claim 2 wherein each of said collapsible end support structures comprises a beyond-center locking toggle having struts hinged to the ends of said side rods and connecting the same hingeably to a central hub, said hub and struts being nestled between said side rods when said toggle is in said frame collapsed position and being spaced outwardly therefrom when said toggle is in said locked, frame erected position.

4. A structurally rigid baby enclosure according to claim 3 wherein each of said beyond-center locking toggles include a flexible strap circumscribing the ends of said side rods associated therewith, said strap defining the toggle center plane through which said hub and struts pass in moving between said frame collapsed and frame erected positions.

5. A structurally rigid baby enclosure according to claim 4 wherein said center plane defining tension strap of at least one of said end support structures is expandable to facilitate the passage through the plane defined thereby of the hub and struts thereof during manipulation of said toggle between said frame collapsed and frame erected positions.

6. A structurally rigid baby enclosure according to claim 5 wherein said plane defining tension strap is expandable at two separate locations adjacent opposed sides of said frame.

7. A structurally rigid baby enclosure according to claim 1 further including a tension strap of a flexible material secured diagonally between the elongate side rods adjacent the upper and lower margin of each of said side panels to provide vertical stability to the sides of said frame structure.

8. A structurally rigid baby enclosure according to claim 7 wherein there are a pair of said tension straps of a flexible material secured diagonally between the side rods adjacent the upper and lower margins of each of said side panels, one of said straps extending between said elongate side members in one diagonal direction and the other of said straps extending between said elongate side members in the opposite diagonal direction.

9. A structurally rigid baby enclosure according to claim 7 further including a pair of tension straps of a flexible material secured diagonally between the side rods adjacent the lower margins of both of said side panels to provide horizontal stability to the bottom of said frame structure, said straps extending in opposite diagonal directions between said elongate side members.

10. A structurally rigid baby enclosure according to claim 9 wherein said baby containment structure of a pliant material is selectively detachable from said frame.

11. A structurally rigid baby enclosure according to claim 7 wherein each of said collapsible end support structures comprises a beyond-center locking toggle having struts hinged to the ends of said side rods and connecting the same hingeably to a central hub, said hub and struts being nestled between said side rods when said toggle is in said frame collapsed position and being spaced outwardly therefrom when said toggle is in said locked, frame erected position.

12. A structurally rigid baby enclosure according to claim 11 wherein said baby containment structure of a pliant material is supported by said frame positioned at a location inwardly of said frame, and said central hub and struts of each of said toggles are spaced outwardly from said enclosure when said toggle is in said locked, frame erected position to minimize possibility of contact therewith by a baby in said containing structure.

13. A structurally rigid baby enclosure according to claim 12 wherein each of said beyond-center locking toggles includes a flexible strap circumscribing the ends of said side rods associated therewith; and defining the toggle center plane through which said hub and struts pass in moving between said frame collapsed and frame erected positions, said center plane defining tension strap of at least one of said end support structures being expandable to facilitate the passage through the plane defined thereby of the hub and struts thereof during manipulation of said toggle between said frame collapsed and frame erected positions.

14. A structurally rigid baby enclosure according to claim 13 further including a pair of tension straps of a flexible material secured diagonally between the side rods adjacent the lower margins of both of said side panels to provide horizontal stability to the bottom of said frame structure, said straps extending in opposite diagonal directions between said side rods; and wherein said baby containment structure of a pliant material is selectively detachable from said frame structure.

15. An erectable baby enclosure collapsed to form an elongate bundle comprising:

A. a baby containment structure of a pliant material which when said enclosure is in an erected condition defines a desired baby containing shape having a pair of opposed side panels; and B. a collapsed frame structure for said enclosure, said structure including:

(1) four side rods extending generally rigidly for the full length of each of said side panels adjacent upper and lower margins thereof, said side rods being positioned close and generally parallel to one another; and (2) a pair of collapsed beyond-center locking toggles coupled to said side members exterior of said pliant material respectively at opposite ends of said frame structure;

(a) each of said toggles having struts hinged to the ends of the side rods at its associated frame structure end and extending therefrom inwardly of said side rods to a central hub with which said struts are hingeably connected;

(b) each of said toggles being manipulatable from said collapsed position to a locked, frame erected position maintaining said side rods spread apart from one another at said frame structure end, supporting said enclosure of a pliant material in said desired baby enclosure shape;

(c) the struts and central hub of each of said toggles projecting outwardly from the remainder of said frame structure when said toggle is in said frame erected position.

* * * * *